US007019707B2

(12) United States Patent
Gottwald et al.

(10) Patent No.: US 7,019,707 B2
(45) Date of Patent: Mar. 28, 2006

(54) MICROWAVE ANTENNA

(75) Inventors: Frank Gottwald, Weissach (DE); Tore Toennesen, Reutlingen (DE); Dirk Steinbuch, Wimsheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/964,397

(22) Filed: Oct. 12, 2004

(65) Prior Publication Data

US 2005/0104780 A1 May 19, 2005

(30) Foreign Application Priority Data

Oct. 9, 2003 (DE) ..... 103 46 847

(51) Int. Cl.
*H01Q 13/00* (2006.01)

(52) U.S. Cl. ..... 343/786; 343/700 MS

(58) Field of Classification Search ..... 343/700 MS, 343/776, 772, 786
See application file for complete search history.

(56) References Cited

U.S. PATENT DOCUMENTS

| | | | | |
|---|---|---|---|---|
| 4,527,165 A | | 7/1985 | de Ronde | 343/773 |
| 5,317,329 A | | 5/1994 | Hatasa | 343/786 |
| 6,061,026 A | * | 5/2000 | Ochi et al. | 343/700 MS |

FOREIGN PATENT DOCUMENTS

| | | |
|---|---|---|
| EP | 0 406 563 | 1/1991 |
| EP | 0 858 126 | 8/1998 |
| GB | 2 301 486 | 12/1996 |
| JP | 08 125 432 | 5/1996 |

* cited by examiner

*Primary Examiner*—Hoang V. Nguyen
(74) *Attorney, Agent, or Firm*—Kenyon & Kenyon LLP

(57) ABSTRACT

In a microwave antenna a dielectric carrier having a strip line is provided. A funnel-shaped or horn shaped waveguide radiator is integrated into a metallic cover, and it is situated above the strip line. A transformation element is provided for the transition from the strip line to the aperture of the waveguide radiator.

9 Claims, 5 Drawing Sheets

MICROWAVE ANTENNA

FIELD OF THE INVENTION

The present invention relates to a microwave antenna comprising a dielectric carrier having at least one strip line, a waveguide radiator being situated above the strip line.

BACKGROUND INFORMATION

A multilayered dielectric carrier having strip lines is known from Japanese Patent Application No. JP-08 125 432 A. A horn-type radiator is coupled to a strip line via a slot in the dielectric carrier. The coupling via the slot requires costly processing of the strip line dielectric carrier. In particular, costly and cost-intensive milling operations have to be carried out in order to remove printed circuit board material.

SUMMARY OF THE INVENTION

Using the principles of the present invention, i.e. a dielectric carrier having at least one strip line, a metallic cover situated over the dielectric carrier and on its strip line side, into which at least one especially funnel-shaped or horn-shaped waveguide radiator is integrated, the base or the exciter end of the funnel-shaped or horn-shaped microwave radiator being situated above one of the strip lines, a transformation element over the strip line for the transition from the strip line to the aperture of the waveguide radiator, it is possible to implement a simple design which does not require any costly processing techniques. Since the foundation or the exciter end of the funnel-shaped or horn-shaped waveguide radiator is situated over a strip line, which, especially at the front end of the dielectric carrier and therewith directly, faces the waveguide radiator, it becomes unnecessary to have an otherwise usual window in the HF earth plane in a slot-coupled patch antenna device which radiates in the direction of the backside of the dielectric HF carrier. The metallic cover provided anyway for the shielding of the antenna feeder circuit, having a required overall height (headroom), is used directly as a waveguide radiator. Into this cover, funnel-shaped or horn-shaped waveguide radiators are integrated making full utilization of its overall height. Since the waveguide opening is directly over the strip line, a construction comes about in which the strip line is turned into a sort of asymmetrical triplate strip line, which finally excites the opening of the waveguide (slot), at its base or exciter end, to oscillate.

Using the design of the present invention, bandwidths that are called for of ca 5 GHz may be implemented. Furthermore, via the geometrical embodiment of the horn/funnel, various angles of aperture in azimuth and elevation may be achieved.

An array of horn antennas or horn antenna apertures gives a similar performance to a slot-coupled patch antenna device which radiates in the direction of the backside of the HF printed circuit board.

DETAILED DESCRIPTION

DETAILED DESCRIPTION

Before describing the actual present invention, solutions are set forth, proposed up to the present, from which the present invention starts, and whose deficiencies it overcomes.

Figure 1A:
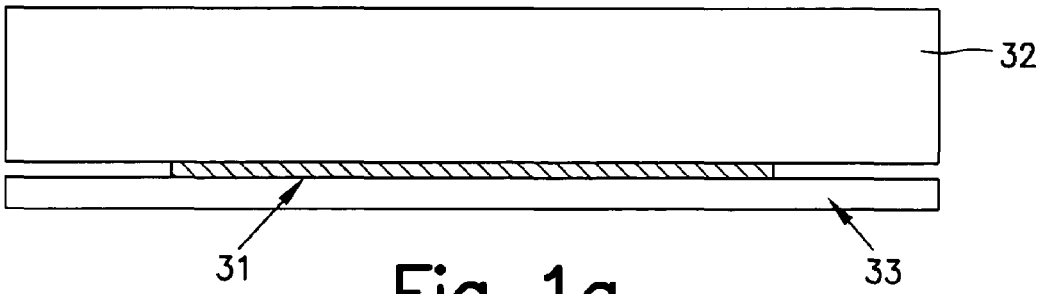
FIG. 1 shows a section through a patch antenna device.
Figure 1B:
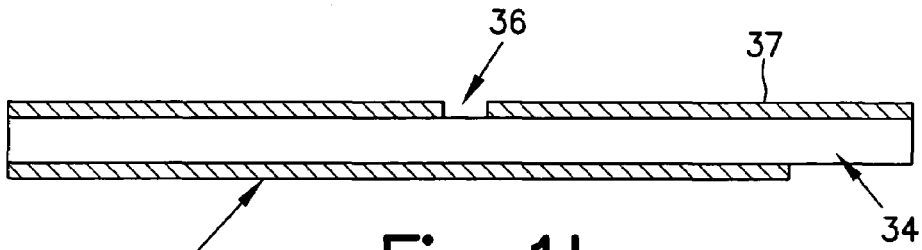
Figure 1C:
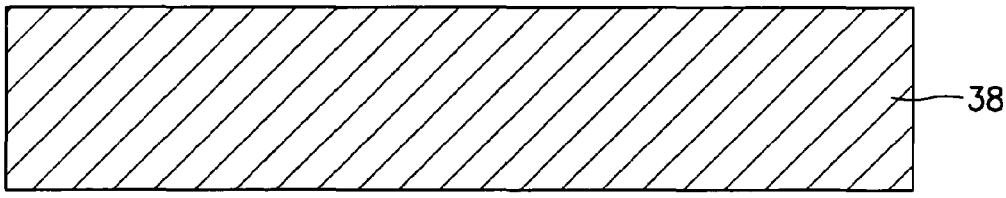

FIG. 1 shows a section through a slot-coupled patch antenna device. A quadratic patch element 31 is located below a protective cover 32 made of polyamide. On its backside is located a polyester foil 33. HF carrier 34 located below this carries on its underside a signal line in the form of a strip line 35. On the upper side of the HF carrier there is a window 36 that is situated perpendicular to strip line 35, which is milled or etched into grounding layer 37. The housing rear panel 38 is below HF carrier 34. The distance between window 36 and patch element 31—air—is less than ¼ of the operation wavelength, for example, 0.9 mm. Window 36 excites patch element 31 to oscillation. In connection with this construction principle, costly and cost-intensive milling operations have to be carried out in order to remove printed circuit board material. The milling operations may be avoided if the radar signal is radiated from the front side of the printed circuit board (the side having the HF components). The disadvantage of using patch antennas is that bandwidth will then be lacking. Furthermore, metallic housing/cover 3 (FIG. 2), for shielding the HF circuit, interferes. Patch 31 is at a distance from printed circuit board 1 having strip line 2 of ca 0.8 to 1 mm. The antenna diagram, as shown in FIG. 2 with regard to the field lines, is bent, and the required large angle of aperture in azimuth, of, for instance, 90° is not able to be implemented.

Figure 3:
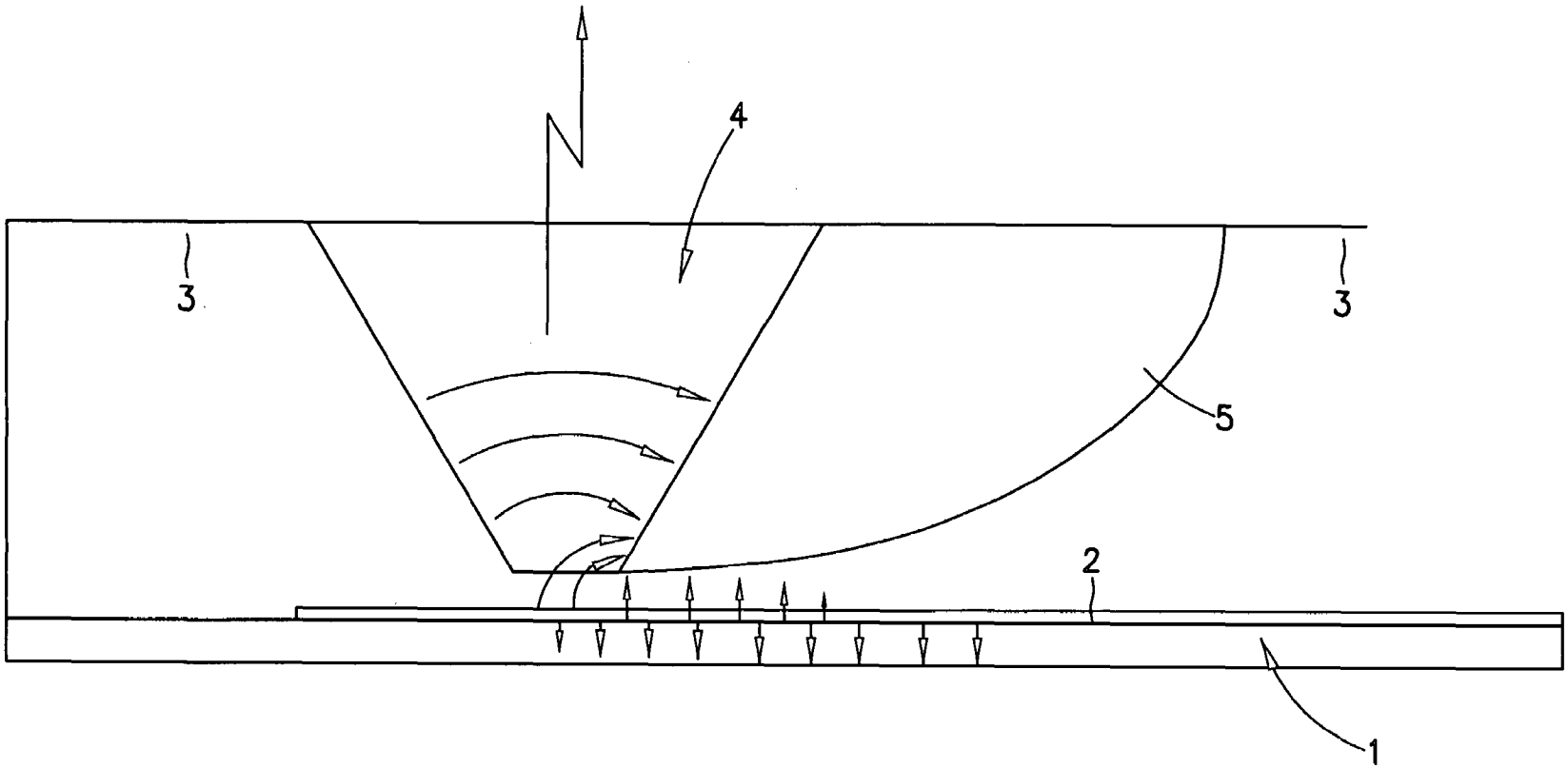
FIG. 3 shows an antenna system according to the present invention having a waveguide radiator.

In the microwave antenna according to the present invention shown in section in FIG. 3, instead of the patch, a funnel-shaped or horn-shaped waveguide radiator 4 is provided, which is integrated into metallic or metallized cover 3. The base or exciter end of waveguide radiator 4 is situated directly over strip line 2 and separated only by an air gap, i.e. strip line 2, in contrast to the patch, is located on the side of dielectric carrier 1 that faces waveguide radiator 4. The entire overall height of cover 3 of 6 mm was utilized for waveguide radiator 4 and its horn-shaped or funnel-shaped aperture in cover 3. Waveguide radiator 4 opens up wider in the radiation direction. Laterally next to waveguide radiator 4 there is provided an especially dielectric transformation element 5, limited with respect to its end face end surfaces by the outer wall of waveguide radiator 4 and the inner surface of cover 3 for the transition of strip line 2 to the aperture of waveguide radiator 4, which acts as a slot. Because of transformation element 5, whose underside 6 is situated over and aligned with strip line 2, and whose thickness is adjusted to the width of strip line 2, the distance of underside 6 from strip line 2 in the direction of the aperture of waveguide radiator 4 from the height of the cover steadily becoming less, i.e. the transformation element has the shape of a circular segment, the field lines starting from strip line 2 are drawn into the aperture of waveguide radiator 4 and form symmetrical circular arcs with respect to the center line of waveguide radiator 4.

Figure 2:
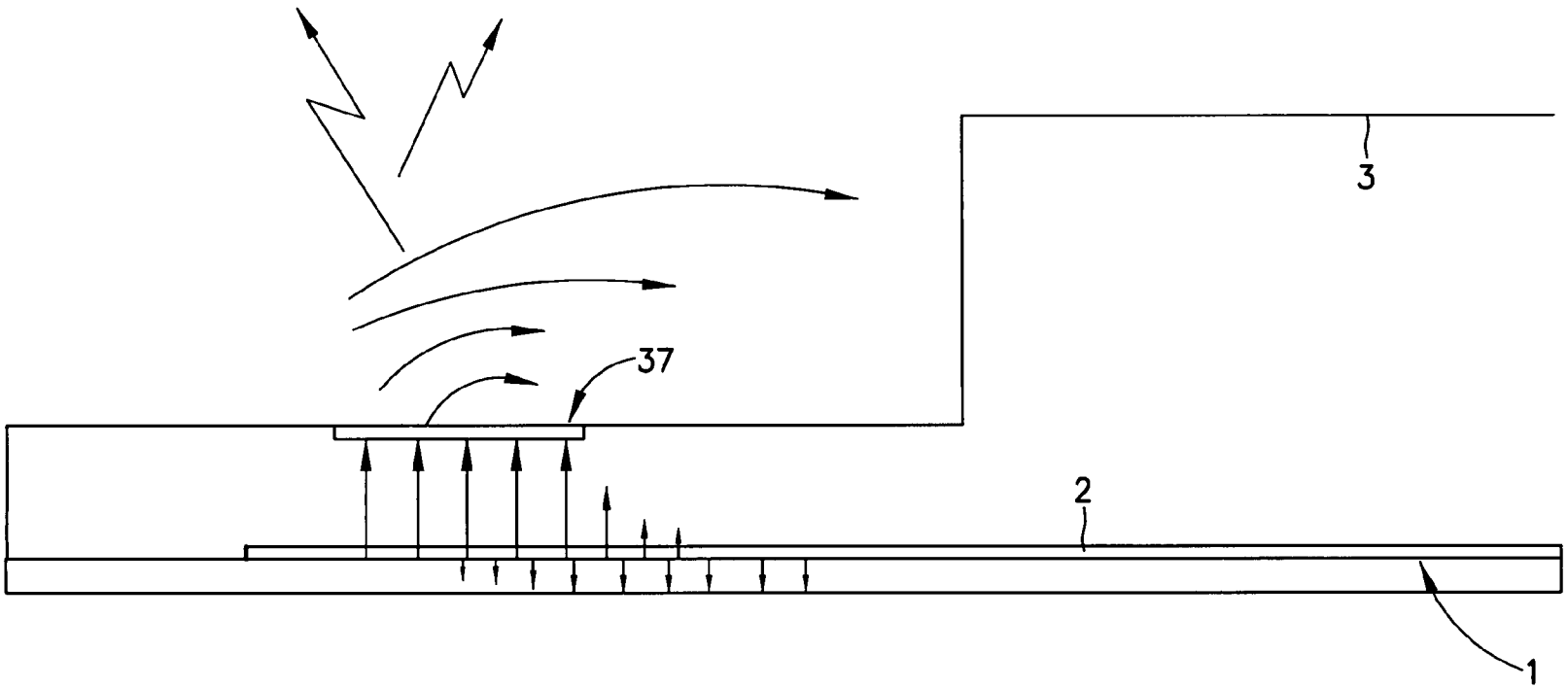
FIG. 2 shows a patch antenna device having a metallic housing.
Figure 4:
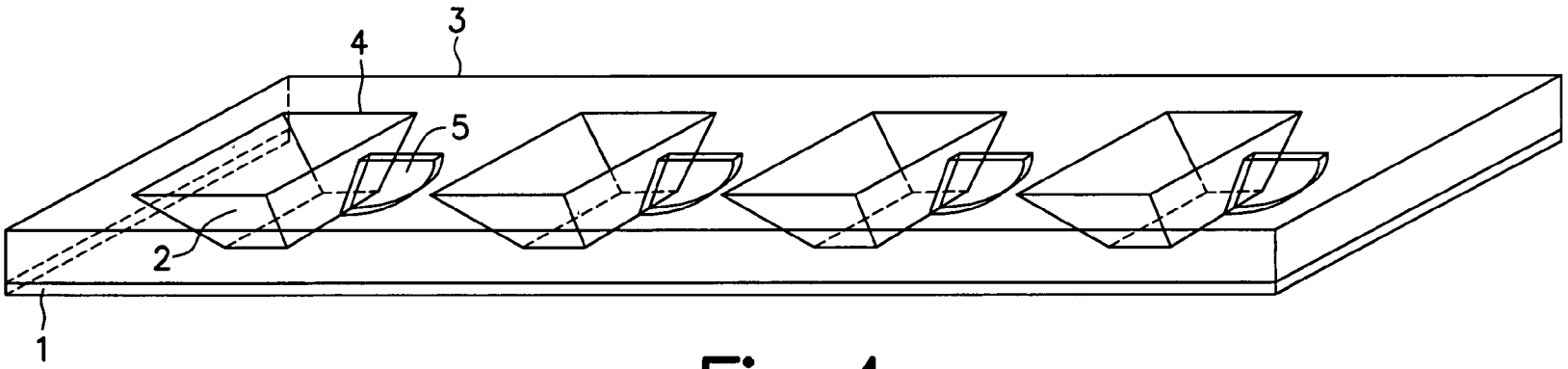
FIG. 4 shows an antenna array having a plurality of waveguide radiators integrated into the cover.
Figure 6:
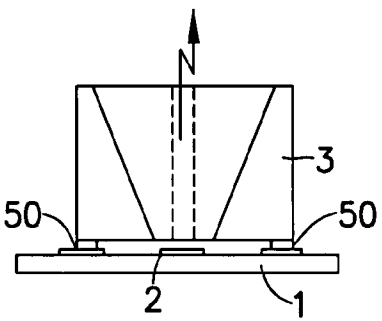
FIG. 6 shows a horn antenna whose cover is designed as an SMD component, in longitudinal section.
Figure 5:
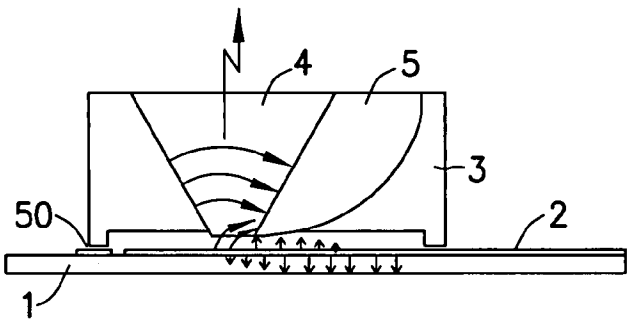
FIG. 5 shows a horn antenna whose cover is designed as an SMD component, in cross section.
Figure 7:
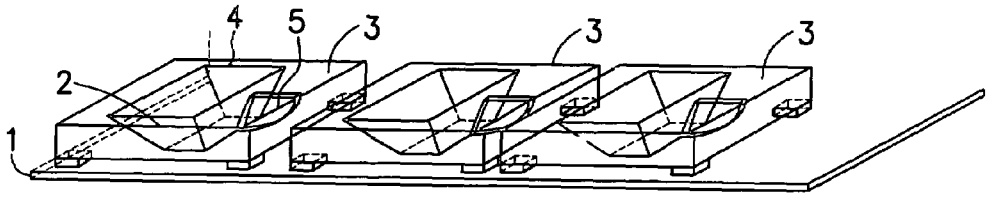
FIG. 7 shows an antenna array having in each case one horn antenna in one SMD component.
Figure 8:
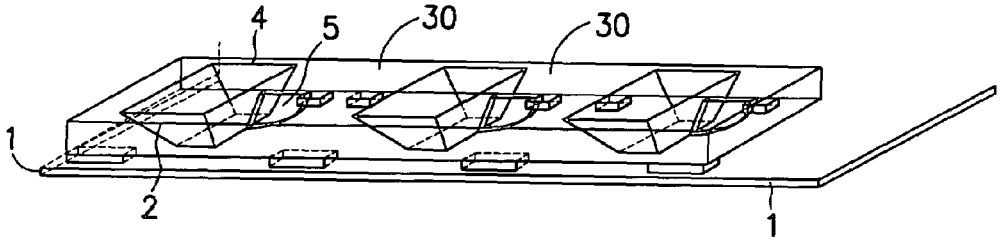
FIG. 8 shows an antenna array having a plurality of horn antennas in one SMD component.

The antenna diagram is therefore symmetrical, by contrast to FIG. 2, and the maximum opening angle in azimuth of 90° is usable. As shown in FIG. 4, the base or exciter end opening of waveguide radiator 4 has a rectangular shape, and, thus, also its cross section, the longer rectangle side being situated vertically above the strip line longitudinal extension. In this connection, strip line 2 lies exactly below the axis of symmetry of the rectangle for the longer rectangle side.

By other geometrical embodiments of the funnel or horn, one may achieve various angles of aperture in azimuth in elevation.

Because of the design according to the present invention, microstrip line 2 goes over into a sort of asymmetrical triplate strip line, which finally excites the lower opening (slot) of waveguide radiator 4 or the horn antenna to oscillation.

In the exemplary embodiment according to FIG. 4, an array of four waveguide radiators 4 in the same cover 3 is shown. These waveguide radiators 4 may be arranged in this array in linear and/or columnar form. For applications in automobile radar, this array is preferably situated in columnar form, in order to limit the vertical aperture angle to 30°, i.e. unnecessary energy is not radiated, especially above the height of obstacles that is to be expected. For the azimuth, the original angle of aperture of 90° is maintained, in order especially to cover adjacent traffic lanes and dead angles. Of course, it is also possible to accommodate each horn radiator in a separate cover. A transformation element 5 is provided in each case between waveguide radiator 4's outer wall and the inside of the cover.

Waveguide radiators 4 are able to be used as transmitting and receiving antennas. Arrays having a different number of individual elements for transmitting and receiving directions may also be provided, so that one may achieve targeted antenna characteristics for special application functions, such as stop and go, precrash, blind spot detection, parking assistant, help for driving in reverse, keyless entry, etc.

Transformation element 5 may be designed as a fin-line or as a step transformer having line segments of the length $\lambda/4$.

Besides waveguide radiators 4, structures 7, especially crosspieces, may be integrated into cover 3, in order to form screen chambers above each individual waveguide radiator 4, especially an array. Both the waveguide radiators and structures 7 may be produced in one operation during production of the cover, for instance, by extrusion technology.

Figure 9:
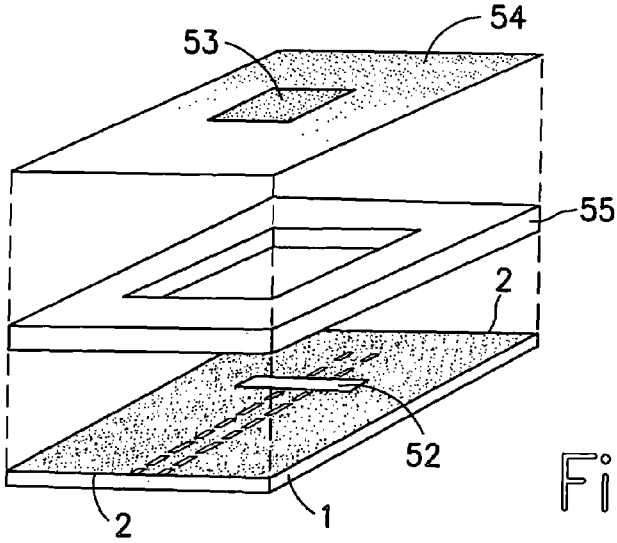
FIG. 9 shows a patch antenna device that may be individually fitted with components.

In the embodiment according to FIGS. 5 to 8, waveguide radiator(s) 4 is/(are) accommodated in each case separately in a cover 3 or together in a cover 30, which is designed as an SMD component. Such a cover 3 or 30 is able to be connected via an adhesive soldering pad and post directly to the HF substrate (dielectric carrier) 1 or its printed circuit boards. Covers 3 or 30 are metallic or are made of partially metallized plastic and are shaped in such a way that they may be applied to the HF substrate by adhesive bonding and/or plug-in mounting. The advantage of partially metallized plastic antennas is that they may be made in almost any desired shape, in order to ensure the transition of the microstrip line to the antenna radiator and the combination of materials having different dielectric constants. Besides horn and funnel antennas, other radiator shapes may also be integrated into cover 3, 30 that is designed as the SMD component, such as notch antennas, Vivaldi antennas or patch antennas. The notch antenna represents a special form of the horn antenna in which the vertical angle aperture of the reduction in the width of the horn may be clearly increased. The patch antenna may be developed, according to FIG. 9, in particular as a slot-coupled antenna, the component side being HF substrate 1, in this case. Strip line 2 is located on the underside as an open-circuited line (stub). A window 52 is provided in the grounding surface on the upper side of HF substrate 1. Cost-driving milled cutouts on the carrier substrate may be avoided. Between patch 52 and patch carrier 54 a frame 55 is provided as a slot patch, which is used as a spacer between patch carrier 54 and the HF substrate.

What is claimed is:

1. A microwave antenna comprising:

a dielectric carrier having at least one strip line;

a cover, the cover being one of metallic and metalized, the cover being situated above the dielectric carrier on a strip line side, at least one waveguide radiator being integrated into the cover, the waveguide radiator being one of substantially funnel-shaped and horn-shaped, one of a base and an exciter end of the waveguide radiator being situated above the strip line; and a transformation element situated above the strip line for a transition from the strip line to an aperture of the waveguide radiator.

2. The microwave antenna according to claim 1, wherein the transformation element includes a dielectric element, whose underside is situated above the strip line, a distance of the underside from the strip line becoming less in a direction of an aperture of the waveguide radiator.

3. The microwave antenna according to claim 1, wherein the transformation element has one of (a) a shape of a circular segment and (b) a stepwise shape, a thickness of the transformation element being adjusted to a width of the strip line.

4. The microwave antenna according to claim 1, wherein the transformation element borders at one end face surface on an outer wall of the waveguide radiator, and borders at an additional end face surface on an inner wall of the cover.

5. The microwave antenna according to claim 1, wherein the waveguide radiator has a rectangular cross section, a longer rectangular side being situated perpendicularly above a strip line longitudinal extension.

6. The microwave antenna according to claim 1, wherein the at least one waveguide radiator includes a plurality of waveguide radiators situated as an array in the cover in at least one of linear form and columnar form.

7. The microwave antenna according to claim 6, further comprising a separate cover associated with each of the waveguide radiators, designed as an SMD component, for at least one of soldering and adhering onto the dielectric carrier.

8. The microwave antenna according to claim 6, wherein the array having the plurality of waveguide rediators is situated in the cover as an SMD component for at least one of soldering and adhering onto the dielectric carrier.

9. The microwave antenna according to claim 1, wherein the cover, on an inside, has structures for forming shielding chambers.

* * * * *